US010558170B2

(12) United States Patent
Junod

(10) Patent No.: US 10,558,170 B2
(45) Date of Patent: Feb. 11, 2020

(54) WHEEL WITH REDUCED MECHANICAL FRICTION FOR TIMEPIECES

(71) Applicant: Montres Breguet S.A., L'Abbaye (CH)

(72) Inventor: Benoit Junod, Peillonnex (FR)

(73) Assignee: Montres Breguet S.A., L'Abbaye (CH)

( * ) Notice: Subject to any disclaimer, the term of this patent is extended or adjusted under 35 U.S.C. 154(b) by 351 days.

(21) Appl. No.: 15/355,567

(22) Filed: Nov. 18, 2016

(65) Prior Publication Data

US 2017/0176946 A1 Jun. 22, 2017

(30) Foreign Application Priority Data

Dec. 18, 2015 (EP) ..... 15201245

(51) Int. Cl.
*G04C 3/10* (2006.01)

(52) U.S. Cl.
CPC ..... *G04C 3/101* (2013.01)

(58) Field of Classification Search
CPC .... G04B 13/002; G04B 13/003; G04B 15/14; G04C 3/004; G04C 3/10; G04C 3/101; G04C 3/105; G04C 5/005
See application file for complete search history.

(56) References Cited

U.S. PATENT DOCUMENTS 3,183,426 A * 5/1965 Haydon ..... G04C 5/005 368/132
3,500,630 A 3/1970 Beguin
3,690,191 A * 9/1972 Hans Ott ..... F16H 31/00 310/21
3,719,839 A * 3/1973 Endo ..... G04C 3/061 310/156.37

(Continued)

FOREIGN PATENT DOCUMENTS

DE 2 361 685 6/1974
EP 0 394 215 A2 10/1990

(Continued)

OTHER PUBLICATIONS

European Search Report dated Jun. 30, 2016 in European Application 15201245.6, filed on Dec. 18, 2015 (with English Translation of Categories of cited documents).

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A sequencer mechanism including a rotatably driven locking wheel set including a peripheral holding surface of regular geometry or respectively of regular uniform magnetic polarity, arranged to hold immobile in rotation an opposite receiver wheel set, which is a reduced friction wheel including at the periphery thereof second stop elements, which are idle rollers or respectively magnets of the same polarity, cooperating in pairs with this holding surface on either side of a plane passing through the centres of the two wheel sets, the locking wheel set including a drive surface including an irregular relief portion or respectively an opposite magnetization and arranged to drive this receiver wheel set in jerks. A timepiece mechanism including such sequencer mechanism. A watch including such a timepiece mechanism and/or such a sequencer mechanism.

21 Claims, 4 Drawing Sheets

(56) References Cited

U.S. PATENT DOCUMENTS

| | | | | |
|---|---|---|---|---|
| 3,969,888 | A | 7/1976 | Veuilleumier et al. | |
| 9,292,002 | B2 * | 3/2016 | Di Domenico | G04C 3/105 |
| 9,891,591 | B2 * | 2/2018 | Di Domenico | G04C 5/005 |
| 9,915,922 | B2 * | 3/2018 | Stranczl | G04B 15/04 |
| 9,927,773 | B2 * | 3/2018 | Di Domenico | G04C 5/005 |
| 10,222,757 | B2 * | 3/2019 | Dinger | G04C 5/005 |
| 2012/0269043 | A1 * | 10/2012 | Baudet | G04C 3/047<br>368/126 |
| 2015/0177690 | A1 * | 6/2015 | Di Domenico | G04C 3/105<br>368/126 |
| 2015/0362892 | A1 * | 12/2015 | Zaugg | G04C 3/064<br>368/168 |

FOREIGN PATENT DOCUMENTS

| | | |
|---|---|---|
| EP | 2 887 157 A1 | 6/2015 |
| FR | 1.147.723 | 11/1957 |

* cited by examiner

WHEEL WITH REDUCED MECHANICAL FRICTION FOR TIMEPIECES

This application claims priority from European Patent application 15201245.6 of Dec. 18, 2015, the entire disclosure of which is hereby incorporated herein by reference.

FIELD OF THE INVENTION

The invention concerns a sequencer mechanism comprising a first rotatably driven locking wheel set, comprising a peripheral holding surface of regular geometry or respectively of regular uniform magnetic polarity, arranged to hold an opposite receiver wheel set immobile in rotation.

The invention also concerns a timepiece mechanism comprising at least one such sequencer mechanism.

The invention also concerns a watch including at least one such timepiece mechanism and/or at least one such sequencer mechanism.

The invention concerns the field of timepiece mechanisms with torque or motion transmission.

BACKGROUND OF THE INVENTION

The invention concerns an alternative to the Maltese cross system, whose function is to convert a continuous rotation into a jerky rotation. This may consist, for example, in rotating a wheel by one step (often a quarter turn) when it passes an irregularity (complementary shape) on a drive wheel set which is subjected to a continuous rotation. This system is, for example, used in horology to make a stopwork, or in perpetual calendar mechanisms to rotate a leap year cam by one quarter turn at each year change.

Such a system is very practical since it uses virtually no energy upon the rotation. Indeed, it does not require a jumper spring to hold the wheel, since its rotation is directly locked by the drive wheel in the event of a shock. This applies to wheels that are not subjected to a torque, but does not apply in the case where the wheel is subjected to a permanent or non-permanent torque. Indeed, the friction generated at the interface between the wheel and the drive wheel represents a permanent consumption of energy proportional to the forces present on the latter.

SUMMARY OF THE INVENTION

The present invention consists in adapting this principle of transformation, in cases where the wheel is subjected to a not inconsiderable torque, and where it is necessary to minimise the braking generated on the driving wheel set.

To this end, the invention concerns a sequencer mechanism according to claim 1.

The invention also concerns a timepiece mechanism comprising at least one such sequencer mechanism.

The invention also concerns a watch including at least one such timepiece mechanism and/or at least one such sequencer mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
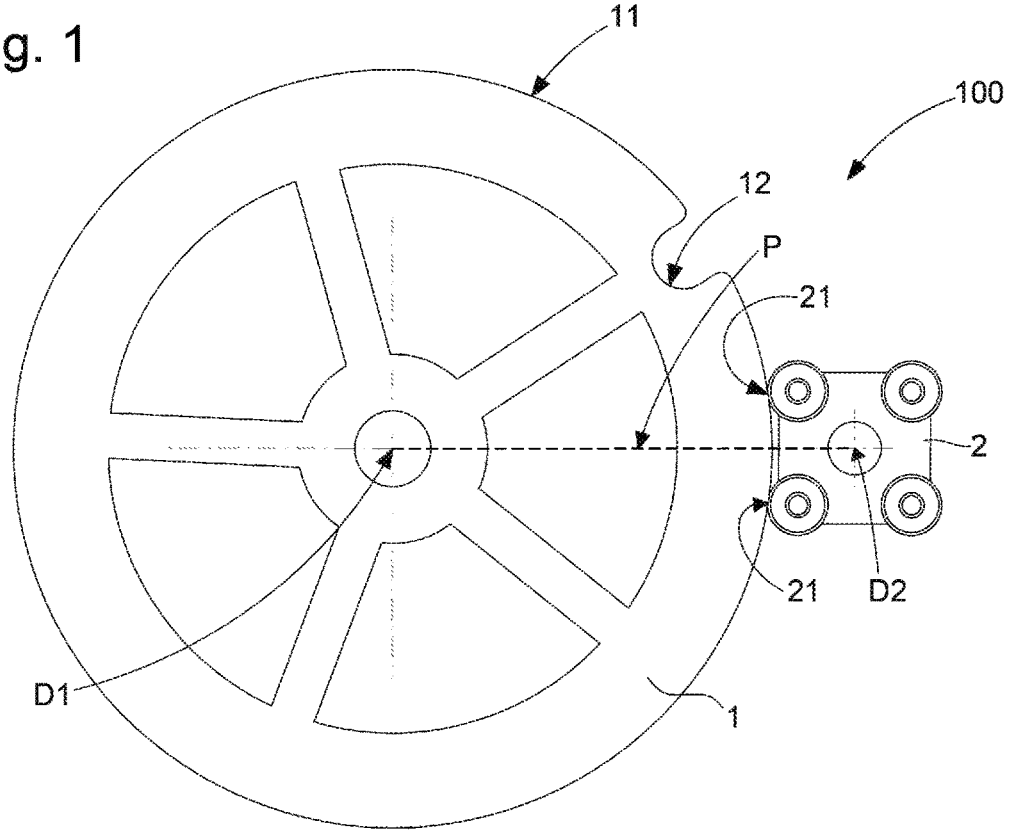
FIG. 1 represents a schematic front view of a first mechanical embodiment of the invention, in a first variant, where a first rotatably driven locking wheel set, comprising a cylindrical peripheral holding surface, and comprising a notch, cooperates with an opposite receiver wheel set, also subjected to a corresponding torque, and carrying rollers arranged to roll on the cylindrical path, and to drop into the notch in passing, in order to pivot the receiver wheel set.
Figure 2:
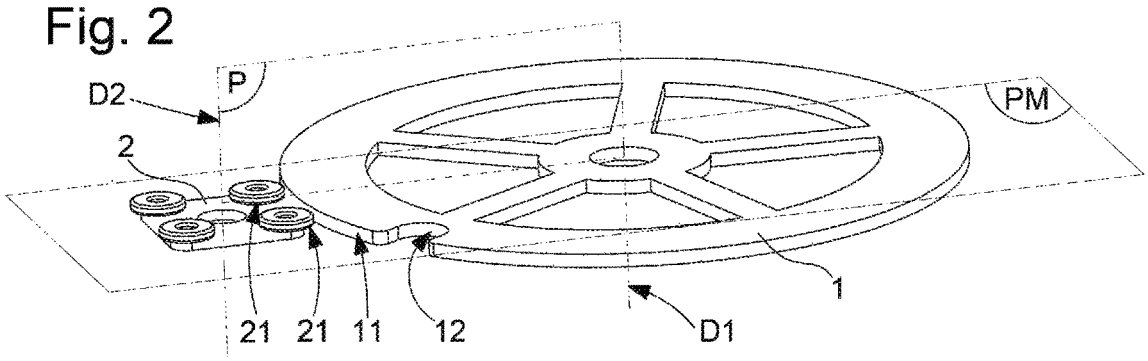
FIG. 2 is a perspective view of the mechanism of FIG. 1.
Figure 3:
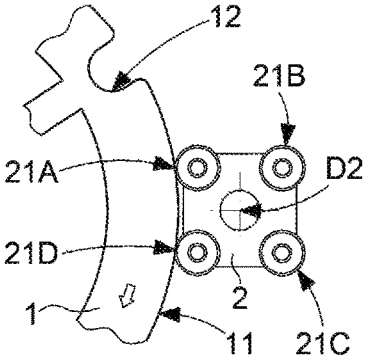
FIGS. 3 to 5 illustrate partial plan views of the steps for passing the discontinuity, and the cooperation of the rollers with the cylindrical path and the notch.

The invention concerns a sequencer mechanism 100 comprising a first locking wheel set 1 driven in rotation about a first pivot axis D1.

This first locking wheel set 1 comprises at least one peripheral holding surface 11, which is of regular geometry or respectively of regular uniform magnetic polarity.

This peripheral holding surface 11 is arranged to hold immobile in rotation, during a locking stroke, an opposite receiver wheel set 2 pivoting about a second pivot axis D2.

According to the invention, receiver wheel set 2 is a wheel set with reduced friction, particularly a wheel in the case of the variants illustrated in the Figures, which comprises at the periphery thereof second stop elements 21. These second stop elements 21, are either idle rollers, when peripheral holding surface 11 is of regular geometry, particularly cylindrical in the non-limiting example of the Figures, or respectively, when peripheral holding surface 11 is of regular uniform magnetic polarity, they are magnets of the same polarity.

Of course, it is possible to replace a smooth path combined with idle rollers, with a toothing combined with idle pinions, or similar, without departing from the present invention. Idle rollers are advantageous due to their lower friction.

The electrostatic variant of the invention is not described in detail here, since the watch designer will know how to transpose the teaching of the magnetic alternative described below to an electrostatic variant, operating in the same manner.

These second stop elements 21 cooperate in pairs with holding surface 11, on either side of a plane passing through the centres of locking wheel set 1 and of receiver wheel set 2, to hold the latter immobile in rotation during the locking stroke.

First locking wheel set 1 also comprises at least one drive surface 12 comprising. either an irregular relief portion when peripheral holding surface 11 is of regular geometry, or respectively an opposite magnetization, when peripheral holding surface 11 is of regular uniform magnetic polarity.

This drive surface 12 is arranged to drive receiver wheel set 2 in jumps, in a drive stroke of first locking wheel set 1 between two locking strokes. It is understood that, with respect to an interaction area of receiver wheel set 2, the rotation of first locking wheel set 1 is an alternate succession of locking strokes, during which receiver wheel set 2 is immobile, and drive strokes, during which receiver wheel set 2 makes a rotation.

More particularly, first locking wheel set 1 is subjected to a drive torque imparting thereto a rotation about first pivot axis D1. Sequencer mechanism 100 is arranged to transform the rotation of first locking wheel set 1 into a jerky rotation of second receiver wheel set 2, which is arranged in immediate proximity to first locking wheel set 1, and pivots about second pivot axis D2, whose position is fixed in space with respect to that of first pivot axis D1. In a particular non-limiting embodiment illustrated by the Figures, second pivot axis D2 is parallel to first pivot axis D1.

First locking wheel set 1 comprises, at the periphery thereof in proximity to the periphery of second receiver wheel set 2, at least a first holding surface 11 and at least a first drive surface 12.

Second receiver wheel set 2 comprises, at the periphery thereof in proximity to the periphery of first locking wheel set 1, a plurality of second stop elements 21. These second stop elements 21 are arranged, in a locking stroke of first locking wheel set 1, to cooperate in pairs with a first holding surface 11, so that at least one of the elements of the pair is cooperating through contact or magnetization with first holding surface 11, in a median plane PM perpendicular to first pivot axis D1, in a stop position where second receiver wheel set 2 is immobile. In this stop position, the two second stop elements 21, which cooperate with first holding surface 11, may be resting on either side of a main plane P passing through the first pivot axis D1 and through the intersection of the second pivot axis D2 with median plane PM.

More particularly, it is the two elements of the pair that are in contact with first holding surface 11.

These second stop elements 21 are also each arranged to cooperate, by mechanical or magnetic drive, depending on the case, with a first drive surface 12 arriving in proximity thereto, to allow the pivoting of second receiver wheel set 2 under the effect of the driving by first locking wheel set 1, or under the effect of a torque to which second receiver wheel set 2 is subjected, in a drive stroke of first locking wheel set 1. In the mechanical alternative, second stop elements 21 comprise idle rollers or similar, which are arranged to roll on a substantially cylindrical path forming first holding surface 11, and which are also arranged to penetrate at least one notch forming a first drive surface 12. This notch is arranged to allow or generate the rotation of second receiver wheel set 2. In the magnetic alternative, second stop elements 21 comprise receiver magnets, which are arranged in repulsion to a path magnetized with a first polarity forming first holding surface 11, and which are also arranged to work in attraction with at least one path of second polarity, opposite to the first polarity forming such a first drive surface 12.

More particularly, first locking wheel set 1 is subjected to a drive torque imparting thereto a continuous rotation about first pivot axis D1.

In a first variant embodiment, as seen in FIGS. 1 to 5 and 11, second receiver wheel set 2 is subjected to a drive torque with respect to second pivot axis D2, corresponding to the drive torque applied to first locking wheel set 1.

In another variant embodiment, as seen in FIGS. 6 to 10, second receiver wheel set 2 is not subjected to any drive torque with respect to second pivot axis D2. Second receiver wheel set 2 may also be subjected to a resistant torque, i.e. in opposition to the drive torque applied to first locking wheel set 1.

In a particular variant, corresponding to the embodiments illustrated by the Figures, the second stop elements 21 are all identical.

More particularly, each first holding surface 11 is arranged to drive at least one second stop element 21 by one step of second receiver wheel set 2, by mechanical contact or by a magnetic force, over a restricted angular driving range of first locking wheel set 1, and first drive surface 12 then comprises two elementary surfaces 13, 14, which are arranged to cooperate with two different second stop elements 21, to allow the pivoting of the second receiver wheel set 2, each over one part of the step.

In a particular variant that is not illustrated, first locking wheel set 1 comprises at least two levels together defining a first air gap, inside which, or in immediate proximity to which, the periphery of second receiver wheel set 2 is movable.

Figure 14:
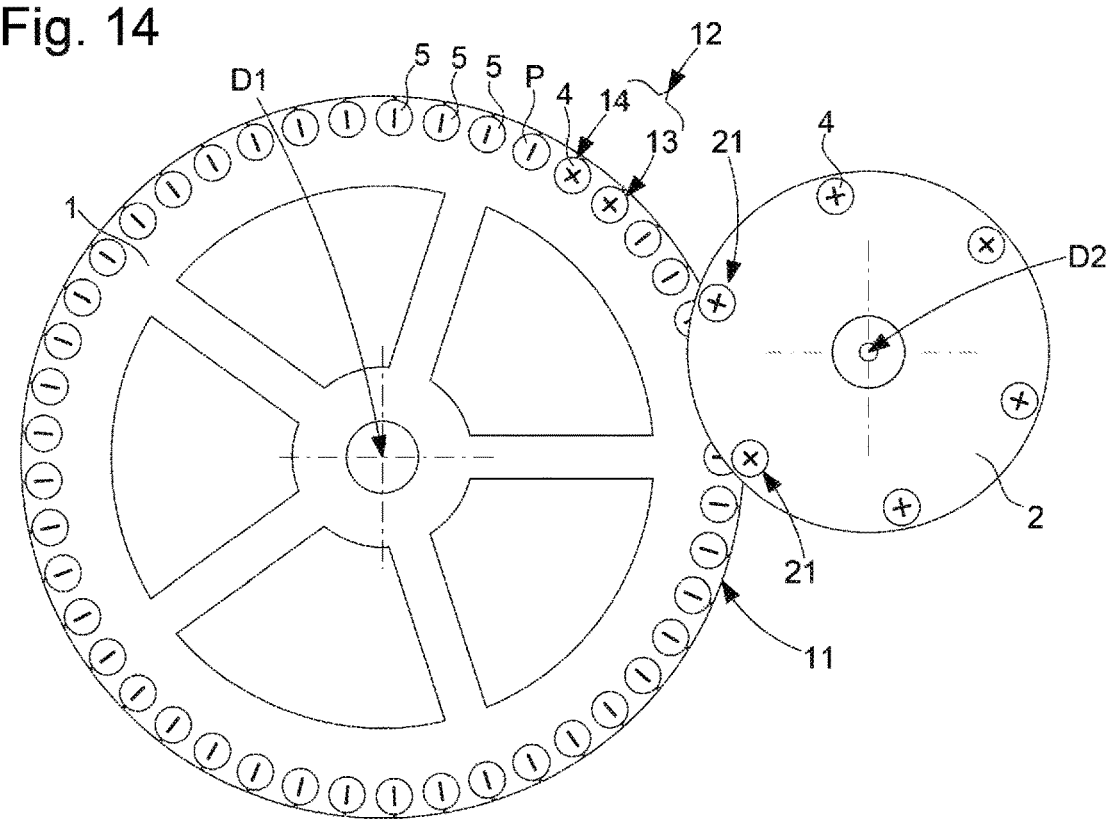
FIG. 14 represents a schematic front view of a second variant wherein the magnetization of all the magnets is oriented in the same direction.
Figure 15:
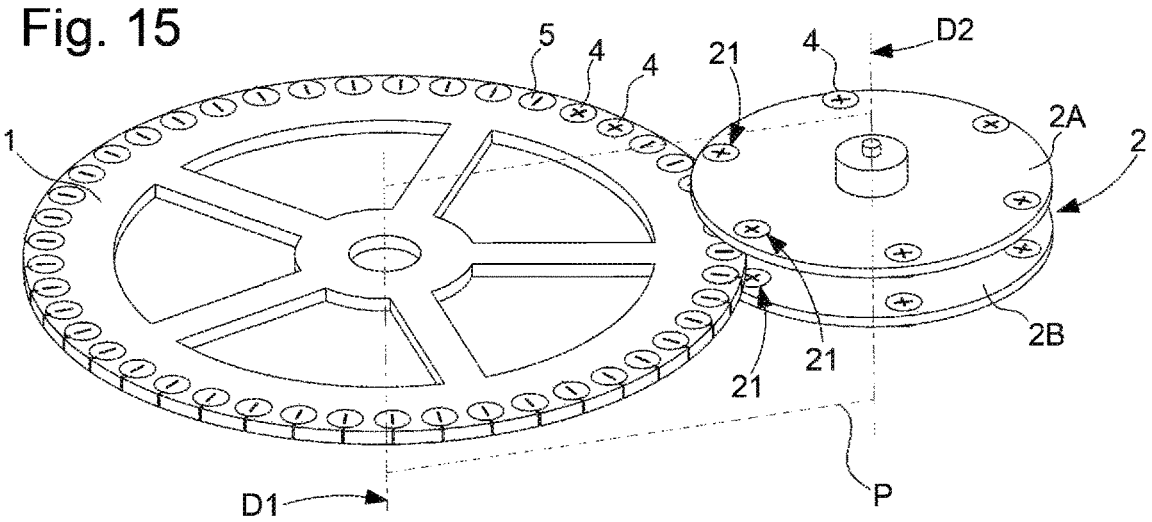
FIG. 15 is a perspective view of the mechanism of FIG. 14.
Figure 16:
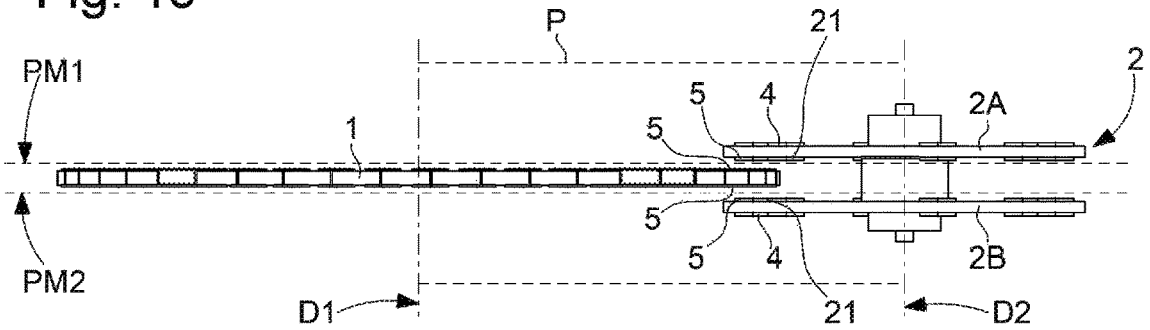
FIG. 16 is a side view of the mechanism of FIG. 14.

In a similar particular variant illustrated in FIGS. 14 to 16, second receiver wheel set 2 comprises at least two levels 2A and 2B, together defining a second air gap, inside which, or in immediate proximity to which the periphery of first locking wheel set 1 is movable.

In a particular variant of the mechanical alternative, second stop elements 21 are each arranged to cooperate by mechanical drive with a first drive surface 12, and second receiver wheel set 2 comprises a plurality of such rollers whose pivot axes are equidistant from second pivot axis D2. These pivot axes may, also, be tilted in a regular manner with respect to second pivot axis D2.

More particularly, and as illustrated in FIGS. 1 to 11, these rollers are equidistant.

Figure 7:
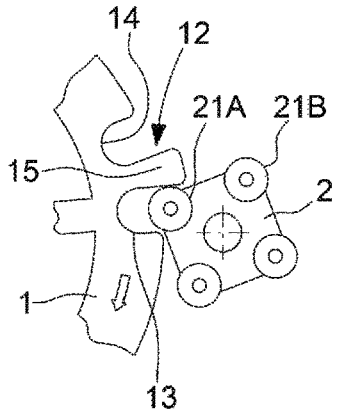
Figure 8:
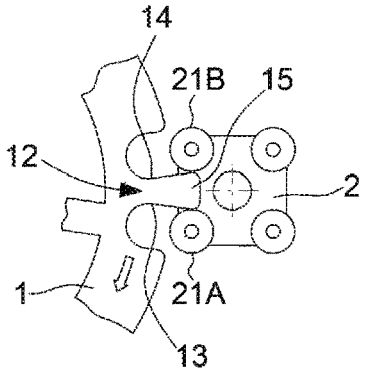
Figure 9:
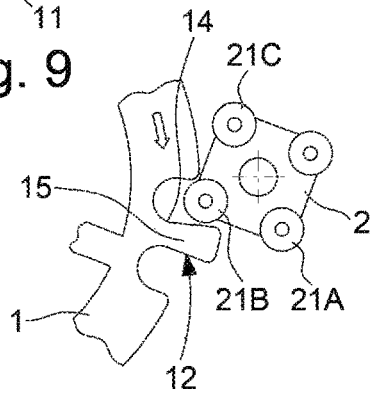

In the variant where second receiver wheel set 2 is not subjected to a drive torque, a particular arrangement is required for it to be able to turn under the action of first locking wheel set 1. More particularly, for this purpose, at least a first drive surface 12 comprises two elementary surfaces 13 and 14 in the form of notches arranged for receiving the rollers, separated by a projecting finger 15, which is arranged to be inserted between two consecutive rollers. This finger 15 is arranged to move into abutment on one of the rollers, on a contact surface which is closer to second pivot axis D2 than the pivot axis of the roller concerned, as seen in FIGS. 7 to 9, for driving in rotation second receiver wheel set 2, when the latter is not driven or is subjected to a resistant torque.

In the magnetic alternative, second stop elements 21 are each arranged to cooperate by magnetic drive with a first drive surface 12, and second receiver wheel set 2 comprises a plurality of second magnets forming the receiver magnets and oriented in the first polarity towards the periphery of first locking wheel set 1. These second magnets are equidistant from second pivot axis D2; this means that the area of highest magnetic field density of each magnet is at the same distance from second pivot axis D2.

More particularly, and as seen in FIGS. 12 to 15, the second magnets are equidistant.

More particularly, first drive surface 12 comprises at least a first attracting magnet oriented in the second polarity towards the periphery of second receiver wheel set 2.

More particularly, first drive surface 12 comprises at least a first ferromagnetic portion in proximity to the periphery of second receiver wheel set 2. It may, in particular, comprise both one or more magnets, and one or more ferromagnetic portions.

More particularly, first holding surface 11 comprises a plurality of first repelling magnets oriented in the first polarity towards the periphery of second receiver wheel set 2.

Figure 12:
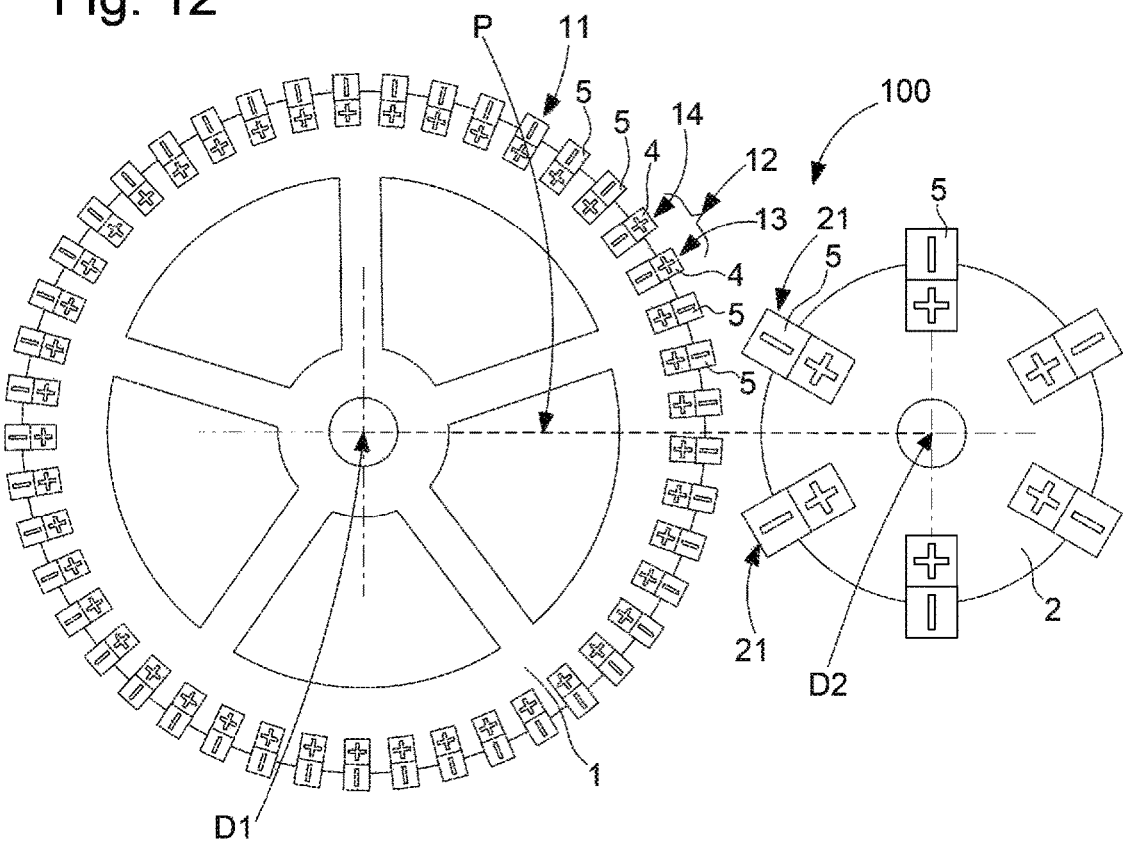
FIG. 12 represents a schematic front view of a second magnetic embodiment of the invention, with magnets on the locking wheel set and on the receiver wheel set, in a first variant where the magnetization of all the magnets is oriented in the same plane.
Figure 13:
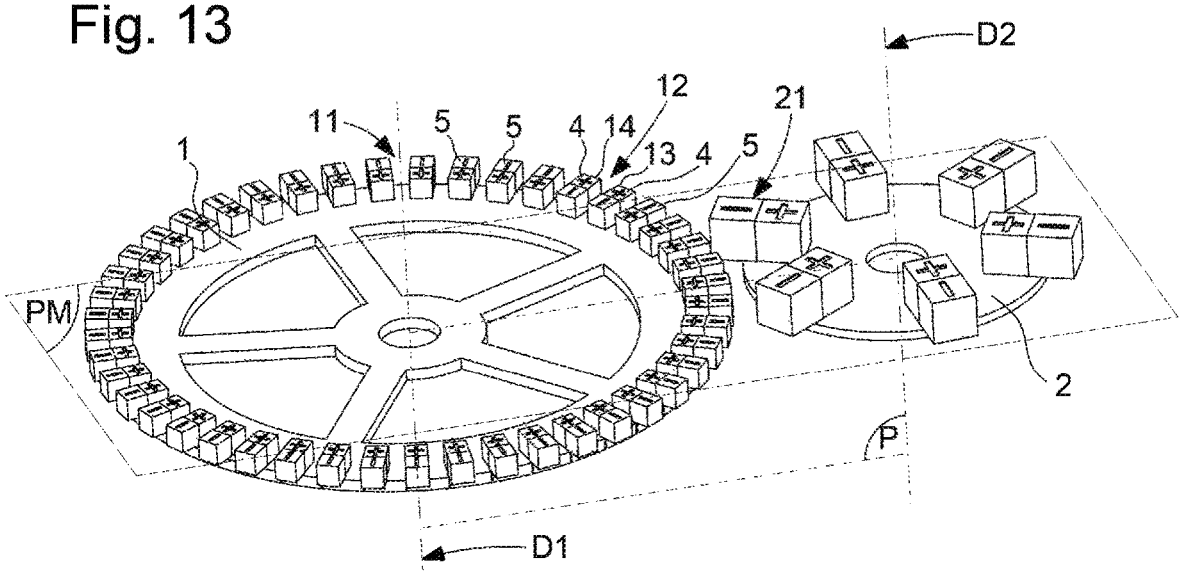
FIG. 13 is a perspective view of the mechanism of FIG. 12.

In the variant illustrated in FIGS. 12 and 13, receiver magnets 21, the magnetized path of the first polarity forming first holding surface 11, and the path of the second polarity forming first drive surface 12, have a magnetization oriented in the median plane PM.

In the variant illustrated in FIGS. 14 to 16, receiver magnets 21, the magnetized path of the first polarity forming first holding surface 11, and the path of the second polarity forming first drive surface 12, have a magnetization oriented parallel to first pivot axis D1.

These particular orientations of magnetization are not limiting. They depend on the space available inside the watch, for optimum positioning of the wheel. If necessary, the direction of magnetization can be oblique, particularly on a conical or other surface.

The invention also concerns a timepiece mechanism 500 comprising at least one such sequencer mechanism 100, and first motor means for driving at least a first locking wheel set 1 of a sequencer mechanism 100. And, when second receiver wheel set 2 of a sequencer mechanism 100 is not subjected to a drive torque corresponding to the drive torque of the corresponding first locking wheel set, the sequencer mechanism 100 concerned is made in the mechanical alternative according to the variant of FIGS. 6 to 10, or is made in the magnetic alternative.

More particularly, timepiece mechanism 500 comprises second motor drive means subjecting a second receiver wheel set 2 of a sequencer mechanism 100 to a torque about second pivot axis D2, corresponding to the drive torque to which is subjected the corresponding first locking wheel set 1 of the same sequencer mechanism 100, so as to provide an additional torque to first locking wheel set 1 during the rotation of second receiver wheel set 2 under the action of a first drive surface 12 of first locking wheel set 1.

The invention also concerns a timepiece, particularly a watch 1000, including at least one such timepiece mechanism 500, and/or at least one such sequencer mechanism 100.

The Figures illustrate non-limiting variant embodiments.

Figure 4:
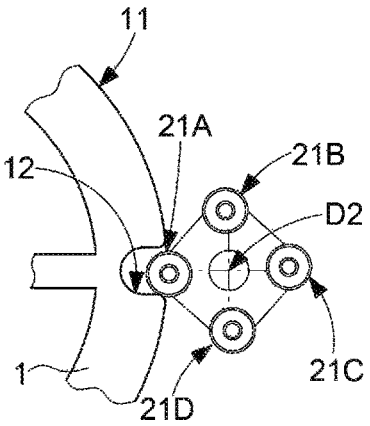
Figure 5:
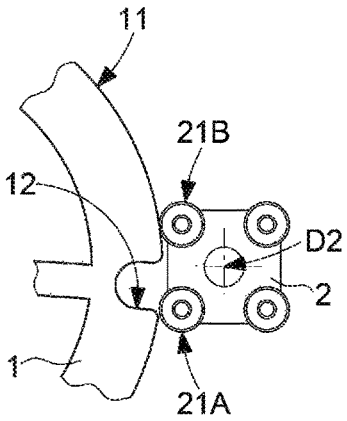
Figure 6:
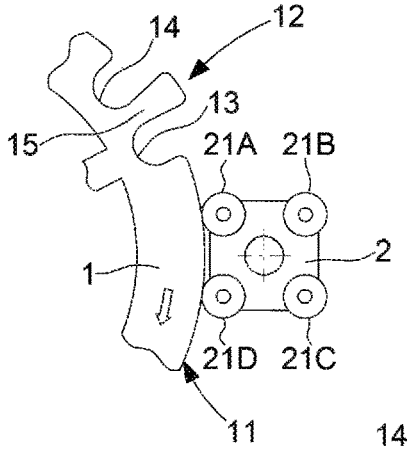
FIGS. 6 to 10 illustrate partial plan views of the steps for passing the discontinuity for a variant wherein the receiver wheel is not subjected to a uniform drive torque, and wherein the locking wheel set is equipped with a finger projecting between two notches, in order to ensure the driving in rotation of the receiver wheel set.

FIGS. 1 to 11 illustrate variants of a mechanical type, with a wheel, which forms second receiver wheel set 2, which is equipped with rollers. In this case, the contact between the wheel and first locking wheel set 1 is preferably achieved via a roller 21, which rolls without slipping over first holding surface 11, and pivots in a pivot of wheel 2. In the holding position in FIG. 3, at least roller 21A, or the two rollers 21A and 21D, are resting on first holding surface 11. When the discontinuity formed by drive surface 12 passes, as seen in FIG. 4, roller 21A can drop into the notch of first locking wheel set 1, and wheel 2, under the effect of a torque represented in FIG. 4 by an anticlockwise arrow, corresponding to the rotation of first locking wheel set 1, can rotate by one step, i.e. a quarter turn in this example where second receiver wheel set 2 carries four rollers 21, equidistant at 90°. Roller 21B then moves into abutment, as does roller 21A which acted as a pivot, on first holding surface 11, as seen in FIG. 5, until the arrival of drive surface 12, which is the same in this particular case of the Figures where there is only one notch 12.

Figure 10:
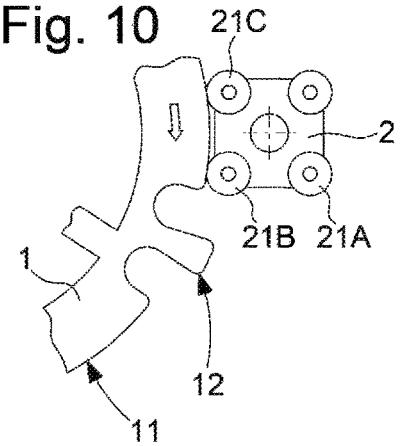

In the case of FIGS. 1 to 5, the shape of first locking wheel set 1 cannot ensure the driving of wheel 2, if the latter is not subjected to a one directional torque. However, by modifying the shape of first locking wheel set 1 in the manner of a Maltese cross, with the aid a projecting finger 15 as explained above, it is possible to ensure such driving even in the absence of torque, or if the torque is not in the desired direction, i.e. in the direction opposite to the imposed rotation. In the holding position in FIG. 6, two rollers 21A and 21D are resting on first holding surface 11. At the arrival of discontinuity 12, as seen in FIG. 7, roller 21A can drop into first notch 13 of first locking wheel set 1, and finger 15 rests on roller 21A to rotate wheel 2 through a first part of its step, and to bring it into the position of FIG. 8. In FIG. 8, the first rotation of wheel 2 moved another roller 21B onto finger 15, which guides it into second notch 14, which drives roller 21B and thus wheel 2 in a further rotation, as seen in FIG. 9, thereby effecting the second part of its step. Roller 21C then moves into abutment, as does roller 21 B which acted as the final pivot, onto first holding surface 11, as seen in FIG. 10, until the arrival of drive surface 12, which is the same in the particular case of the Figures where there is only one said drive surface, formed of two notches 13 and 14 and finger 15. Here, wheel 2 has made a rotation of 180°.

This variant of FIGS. 6 to 10 thus permits a rotation, even if wheel 2 is not subjected to a torque in the direction allowing it to be driven.

FIGS. 12 to 16 illustrate variants of a magnetic type, with a wheel, which forms second receiver wheel set 2, which is equipped with magnets, and which is contactless, which is even more favourable than the light contact of the mechanical variants. The Figures makes a distinction between references 4 and 5 according to polarity: 4: +or North, 5: −or South.

In this embodiment, magnets 21 of wheel 2 are in repulsion to the magnets of first locking wheel set 1. The position of wheel 2 is thus locked in a stable position, despite the torque which tends to cause it to rotate (anticlockwise in FIGS. 12 and 13). When the magnets of first locking wheel set 1 pass, which have an opposite direction of magnetization, magnets 21 of the wheel are attracted, and the wheel can rotate by one step, i.e. one sixth of a turn in the case illustrated. The examples of FIGS. 12 and 13 illustrate the case where the magnets have a magnetization oriented in the plane.

In a variant embodiment, the same principle can be applied for magnets whose magnetization is oriented along first pivot axis D1, as seen in FIGS. 14 to 16. In this particular case, wheel 2 has two levels of magnets in attraction, on two median planes PM1 and PM2. It is entirely possible to envisage having two levels on first locking wheel set 1 rather than on the wheel on the same principle. The solutions proposed above make it possible to allow the rotation of a wheel alternately subjected to a torque, and while limiting energy consumption when the wheel does not rotate (at rest). Many applications can be envisaged with this type of system.

Naturally, it is possible to reverse the magnetic alternative, with a holding position in magnetic attraction, and a driving action via repulsion, however this solution may have instability, which requires a significant torque on the first locking wheel set to compensate such instability.

A first application concerns a temporary supply of torque. Indeed, in many cases, timepiece movements have complications which generate an additional torque consumption, but for a limited time period. This is notably the case of simple, annual, perpetual or other calendar mechanisms, which use energy from the movement on the change of date, generally at midnight. This energy consumption involves a local drop in amplitude and thus a reduction in power reserve.

Figure 11:
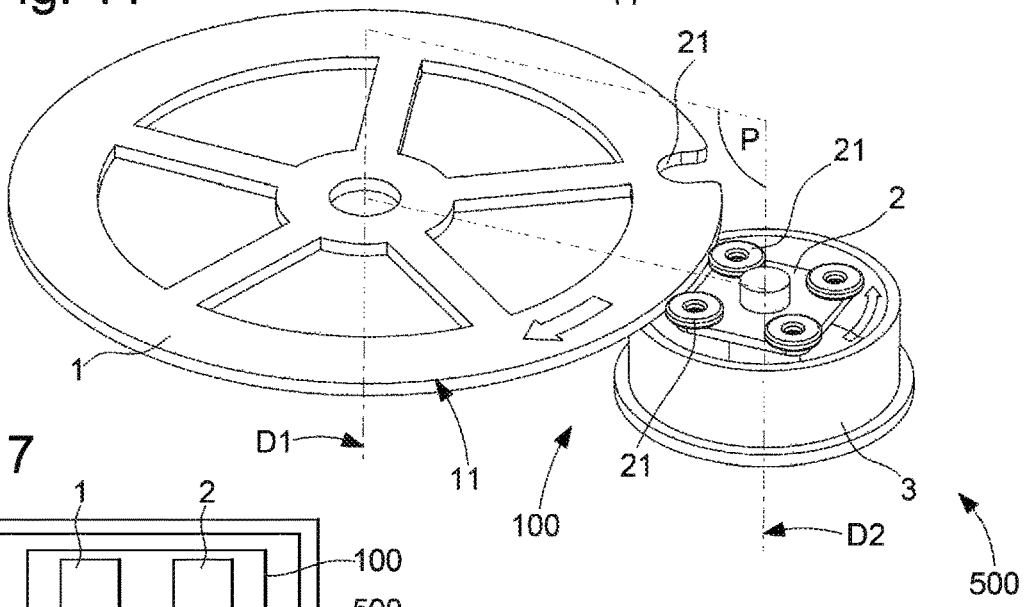
FIG. 11 represents a schematic perspective view of an application of the mechanism of FIG. 1 in combination with an additional barrel to provide temporary additional torque to the locking wheel set.
Figure 17:
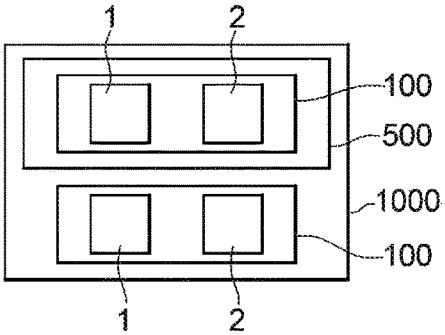
FIG. 17 is a block diagram representing a watch with a movement, including sequencer mechanisms according to the invention.

The system described may supply additional torque during this period of extra energy consumption. If wheel 2 is connected to an auxiliary barrel 3 of smaller size than the main barrel, or a simple spiral spring or a strip or any elastic or magnetic return means, and first locking wheel set 1 is directly or indirectly connected to the going train and dimensioned to make one revolution in 24 hours (if the extra consumption occurs once every 24 hours), then wheel 2 could provide torque to first locking wheel set 1 during the consumption period and thereby prevent a drop in amplitude on the change at midnight and thus increase the power reserve. This variant is illustrated in FIG. 11.

Another example application concerns a torque variator. In the case of a system, particularly a differential, that can modify the torque ratio between two wheel sets, for example barrel/centre wheel, to make the torque constant as the barrel unwinds, it is necessary to drive in rotation a lever, or a planetary wheel carrier, so that the latter adapts the position of the planetary wheel according to the state of winding of the barrel. This lever is thus subjected to a torque that must be maintained. Wheel 2, alternately driven in rotation by first locking wheel set 1, which, in this example, is the barrel drum, can drive the lever which therefore transmits a not inconsiderable torque thereto. The solution according to the invention makes it possible to hold wheel 2 immobile, with limited energy consumption, despite the torque to which it is subjected.

Very many applications are possible, in particular but not limited to:

- timepiece movements comprising a complication using torque at regular intervals, for example every 24 hours;
- timepiece movements comprising a torque variator, for example to achieve a constant torque;
- timepiece movements comprising an alternating drive system, for example leap year cams in a perpetual calendar mechanism, to reduce torque consumption;
- chronographs comprising a minute counter or hour counter, with alternating drive to reduce torque consumption.

What is claimed is:

1. A sequencer mechanism comprising:

a locking wheel set driven in rotation about a first pivot axis, the locking wheel set comprising a peripheral holding surface of uniform magnetic polarity at a periphery of the locking wheel set, the peripheral holding surface arranged to rotationally immobilize a receiver wheel set about a second pivot axis, wherein said receiver wheel set includes a plurality of stop elements at a periphery of the receiver wheel set, the stop elements being magnets of a same polarity, and wherein, in a locking stroke of said locking wheel set, two stop elements of the plurality of stop elements cooperate, through magnetization, with said peripheral holding surface on opposite sides of a plane passing through a center of said locking wheel set and a center of said receiver wheel set to rotationally immobilize the receiver wheel set, wherein said locking wheel set further comprises a drive surface that includes an opposite polarity of the peripheral holding surface arranged to drive said receiver wheel set in a drive stroke of said locking wheel set, and wherein said drive stroke occurs between two locking strokes.

2. The sequencer mechanism according to claim 1, wherein the plurality of stop elements are at the periphery of the receiver wheel set and proximal to the periphery of the locking wheel set, wherein the stop elements cooperate in pairs with said peripheral holding surface, such that at least one stop element of said pair cooperates through magnetization with said peripheral holding surface, on a median plane perpendicular to said first pivot axis, in a stop position in which said receiver wheel set is rotationally immobile and the stop elements cooperating with said peripheral holding surface, rest on either side of a main plane passing through the first pivot axis and through an intersection of the second pivot axis with said median plane, and wherein said stop elements cooperate, by magnetic drive, with the drive surface to pivot said receiver wheel set, wherein said stop elements are receiver magnets, arranged in repulsion to a path magnetized with a first polarity, that forms said peripheral holding surface, and arranged to work in attraction with at least one path of second polarity, opposite to said first polarity, that forms said drive surface.

3. The sequencer mechanism according to claim 2, wherein said receiver magnets, said magnetized path of the first polarity, and said at least one path of the second polarity, each have a magnetization oriented in said median plane.

4. The sequencer mechanism according to claim 1, wherein, in a holding position, two of said stop elements cooperate with said peripheral holding surface on either side of said plane passing through the centers of said locking wheel set and of said receiver wheel set.

5. The sequencer mechanism according to claim 1, wherein said locking wheel set is subjected to a drive torque which imparts a continuous rotation of said locking wheel set about said first pivot axis.

6. The sequencer mechanism according to claim 1, wherein said receiver wheel set is subjected to a drive torque or resistant torque with respect to said second pivot axis.

7. The sequencer mechanism according to claim 1, wherein said stop elements are all identical to each other.

8. The sequencer mechanism according to claim 1, wherein said second pivot axis is parallel to said first pivot axis.

9. The sequencer mechanism according to claim 1, wherein said peripheral holding surface is arranged to lock at least one of said stop elements by a magnetic force, over a restricted angular driving range of said locking wheel set, and wherein said drive surface includes two elementary surfaces arranged to cooperate with two different stop elements of said stop elements to ensure pivoting of said receiver wheel set, each of said two different stop elements cooperating with a respective elementary surface over a portion of a step of the receiver wheel set.

10. The sequencer mechanism according to claim 1, wherein the locking wheel set comprises at least two levels which together define an air gap between the at least two levels, and wherein the periphery of the receiver wheel set is movable inside or in immediate proximity to the air gap.

11. The sequencer mechanism according to claim 1, wherein said receiver wheel set comprises at least two levels, which together define an air gap between the at least two levels, and wherein the periphery of the locking wheel set s movable inside or in immediate proximity to the air gap.

12. The sequencer mechanism according to claim 1, wherein each of said stop elements is arranged to cooperate by magnetic drive with said drive surface, and wherein each said stop element is a receiver magnet and is oriented with a first polarity directed towards the periphery of said locking wheel set, and wherein areas of highest magnetic field density of each of said receiver magnets are equidistant from said second pivot axis.

13. The sequencer mechanism according to claim 12, wherein said receiver magnets are equidistant from each other.

14. The sequencer mechanism according to claim 12, wherein said drive surface further comprises a first attracting magnet oriented with a second polarity directed towards the periphery of said receiver wheel set, and wherein said second polarity is opposite said first polarity.

15. The sequencer mechanism according to claim 12, wherein said drive surface comprises a ferromagnetic portion in proximity to the periphery of said receiver wheel set.

16. The sequencer mechanism according to claim 12, wherein said peripheral holding surface comprises a plurality of repelling magnets oriented with said first polarity directed towards the periphery of said receiver wheel set.

17. The sequencer mechanism according to claim 12, wherein said receiver magnets, a magnetized path of the first polarity, and a path of the second polarity, have a magnetization oriented parallel to said first pivot axis.

18. A timepiece mechanism comprising at least one sequencer mechanism according to claim 12, and a motor for driving said locking wheel set of said sequencer mechanism.

19. A timepiece mechanism comprising at least one sequencer mechanism according to claim 1, and a motor for driving said locking wheel set of said sequencer mechanism.

20. The timepiece mechanism according to claim 19, wherein said timepiece mechanism comprises a second motor subjecting said receiver wheel set of said sequencer mechanism to a torque about said second pivot axis to supply an additional torque during said drive stroke of said locking wheel set.

21. A watch including at least one sequencer mechanism according to claim 1.

* * * * *